United States Patent [19]

Scholz et al.

[11] Patent Number: 4,758,759

[45] Date of Patent: Jul. 19, 1988

[54] LAMP WITH LIGHT-SOURCE CAPSULE SUPPORT MEMBERS HAVING EQUAL THERMAL CONDUCTIVITY

[75] Inventors: John A. Scholz, Beverly, Mass.; William G. Thiry, Winchester, Ky.; Robert S. White, Beverly, Mass.

[73] Assignee: GTE Products Corporation, Danvers, Mass.

[21] Appl. No.: 927,891

[22] Filed: Nov. 6, 1986

[51] Int. Cl.[4] ..... H01J 5/46; H01J 61/34; H01J 61/36; H01K 1/40

[52] U.S. Cl. ..... 313/25; 313/40; 313/46; 313/631

[58] Field of Search ..... 313/25, 113, 631, 574, 313/13, 28, 39, 40, 42, 46

[56] References Cited

U.S. PATENT DOCUMENTS 4,015,158 3/1977 Roller et al. ..... 313/25
4,253,037 2/1981 Driessen et al. ..... 313/113 X

FOREIGN PATENT DOCUMENTS 2034016A 5/1980 United Kingdom ..... 313/25

*Primary Examiner*—David K. Moore
*Assistant Examiner*—K. Wieder
*Attorney, Agent, or Firm*—Joseph S. Romanow

[57] ABSTRACT

A single-ended lamp having a double-ended light-source capsule mounted axially within an outer envelope on thermally conductive support members such that the amount of heat conducted to the base region of the lamp through each support member is approximately equal. In a preferred embodiment, a high-pressure sodium PAR lamp having a temperature-sensitive component in the lamp base employs two support wires for the arc tube; the support wire coupled with the arc tube end closer to the lamp base has a loop formed therein so that the lengths of both support wires are approximately equal and the thermal conductivity of both support wires are also approximately equal in the operating environment of the lamp; whereby the temperature-sensitive component operates within acceptable temperature limits. In alternate embodiments, each support member may employ one or more loops or other configurations in order to minimize the amount of heat transferred to the lamp base through conduction in the support members. The invention has particular application in lamps having temperature-sensitive components or materials in the base region of the lamp, or where the temperature of the lamp socket or its surroundings is particularly constrained.

16 Claims, 4 Drawing Sheets

LAMP WITH LIGHT-SOURCE CAPSULE SUPPORT MEMBERS HAVING EQUAL THERMAL CONDUCTIVITY

TECHNICAL FIELD

This invention relates to the field of single-ended electric lamps and more particularly to such lamps having a double-ended light-source capsule mounted axially within an outer envelope on support members which have approximately equal thermal conductivity to the base region of the lamp. The invention has particular application in lamps having temperature-sensitive components or materials in the base region or where the temperature of the lamp socket or its surroundings is particularly constrained.

BACKGROUND ART

A lamp with a cool operating temperature in its base region provides several advantages. As used herein, the "base region" of a lamp includes the lamp base and the volume enclosed within the base. Excessive base temperature may adversely affect performance of the lamp. It may shorten the life of the luminaire, the electrical supply circuit, or components of the starter circuit. Excessive base temperature may also result in unsafe heating of combustible materials which form a part of the luminaire or of the materials adjacent to the luminaire. Excessive temperature in the base region may cause failure of the basing cement as well as softening of solder used to connect the lead-in wires to the base.

In modern lamps, it is not uncommon for temperature-sensitive components to be placed in the base region. For example, a high-pressure sodium PAR lamp utilizes a non-linear dielectric element (NLDE) as a component of the starting circuit. The NLDE is situated in the base region. At elevated temperatures, the peak voltage output of the NLDE is reduced. Although heating the NLDE is not a detriment to initial start-up or during lamp operation, it does significantly deter the hot-restart capability of the lamp. This is a serious drawback. Accordingly, adequate thermal isolation of the NLDE during operation is not only desirable but essential for the lamp to be a viable commercial product.

There are various known techniques for reducing the operating temperature of the base region of a lamp. One technique is to increase the distance between the heat source, e.g., arc tube or filament, and the base region. Another technique is to insert insulating material between the heat source and base region. Heat reflective means, such as a metal or mica disk, may be employed to shield the base region from incident radiation. While these techniques are effective, they will generally necessitate increased lamp size or additional materials and associated labor. Moreover, the light-emitting characteristics of the lamp, particularly a PAR lamp, may be comprised by larger lamp size or inclusion of additional materials within the lamp.

It would be an advancement of the art if there were available a method of preventing excessive operating temperatures in the base region of a lamp which does not necessitate increased lamp size nor inclusion of additional insulating or reflective materials within the lamp. Such a method should be simple and inexpensive and, preferably, would involve only slight modification of existing lamp parts.

DISCLOSURE OF THE INVENTION

It is, therefore, an object of the invention to obviate the deficiencies in the prior art.

It is another object of the invention to provide a method and design for a lamp wherein excessive operating temperatures do not occur in the base region. Such method and design do not necessitate a larger lamp size nor inclusion of additional insulating or reflective materials within the lamp.

It is a further object of the invention to provide simple and inexpensive means for preventing excessive operating temperatures in the base region of a lamp.

Yet another object of the invention is to provide a design for a lamp having a temperature-sensitive component in its base region such that the operating temperature within the base region remains within optimal or acceptable limits.

Still a further object of the invention is to provide a design for a high-pressure sodium PAR lamp having a temperature-sensitive NLDE starting component in the base region wherein the hot-restart capability is not substantially deterred by excessive heating of the NLDE.

Another object of the invention is to improve the ability of the light-source capsule to conserve heat, and thereby to enhance the efficacy of the lamp.

These objects are accomplished, in one aspect of the invention, by provision of a single-ended lamp comprising an outer envelope having a longitudinal axis, a body, and a neck. At least a portion of the outer envelope is light-transmissive.

The lamp includes a light-source capsule having a central axis and first and second opposed ends. The light-source capsule is mounted within the outer envelope such that the central axis is substantially coincident with the longitudinal axis and the first end is closer to the neck of the outer envelope than is the second end. Each end has a thermally conductive lead-in mounted therein. The light-source capsule is heat producing during operation of the lamp.

The lamp further includes first and second thermally conductive support members for supporting the light-source capsule. The first support member is thermally coupled with the lead-in of the first end of the light-source capsule; the second support member is thermally coupled with the lead-in of the second end of the light-source capsule.

A base is mounted on the neck of the outer envelope. The base encloses an interior volume which is thermally coupled with the first and second support members.

The first and second support members have been separately adapted such that during operation of the lamp the amount of heat conducted to the interior volume of the base through the first support member is approximately equal to the amount of heat conducted to the interior volume of the base through the second member.

Lamps constructed as above described will prevent excessive heating of the base region during operation. This advantage is obtained simply, inexpensively, and without adversely affecting the light-emitting characteristics of the lamp.

BEST MODE FOR CARRYING OUT THE INVENTION

For a better understanding of the present invention, together with other and further objects, features, advantages, and capabilities thereof, reference is made to the following disclosure and appended claims taken in conjunction with the above-described drawings.

As used herein, the term "light-source capsule" includes an arc tube of an arc discharge lamp, an incandescent capsule, or any light-emitting tube or capsule within the outer envelope of a lamp. The term "arc tube" includes both a high-pressure sodium arc tube and a metal-halide arc tube, and "incandescent capsule" includes a tungsten-halogen incandescent capsule. The term "loop" as employed herein includes any curve which bends back and crosses itself or which bends back and almost crosses itself.

Figure 1:
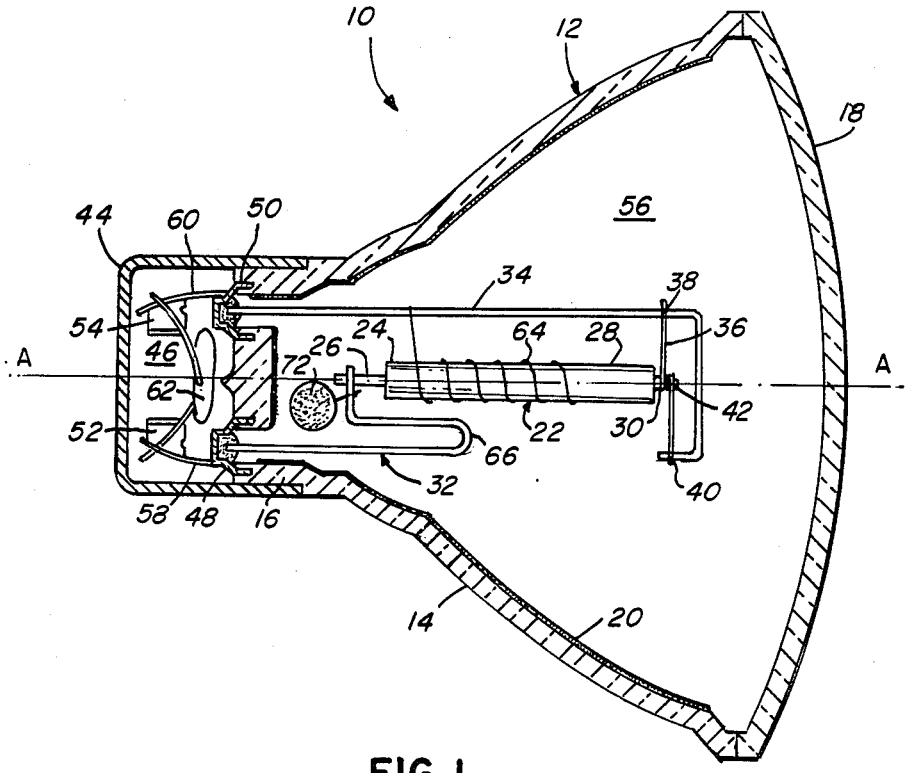
FIG. 1 is a cutaway view of a reflector lamp in accordance with the invention showing internal lamp parts in elevation and the outer envelope in cross section.

FIG. 1 shows reflector lamp 10 comprising outer envelope 12 having longitudinal axis A—A. Outer envelope 12, which may be glass, includes light-transmissive lens 18 mounted on body 14, and neck 16. Body 14 has reflector coating 20 adhering to its inner surface. Light-source capsule 22, in this embodiment being a high-pressure sodium arc tube with an alumina envelope, is mounted within outer envelope 12 along axis A—A. Arc tube 22 has first end 24 having thermally conductive lead-in 26 mounted therein and second end 28 with thermally conductive lead-in 30 mounted therein. Lead-ins 26 and 30 may be hollow niobium tubing in order to facilitate a seal between the lead-in and alumina arc tube. During operation, arc tube 22 produces a substantial amount of heat.

Arc tube 22 is mounted on two thermally conductive support members 32 and 34, which may be stainless steel wire or nickel-plated steel wire, sufficiently rigid for a stable mount. First lead-in 26 is mounted on first support member 32, such as by welding. Second lead-in 30 is mounted on second support member 34, preferably by means of wire 36 welded to lead-in 30 and support 34 at points 38 and 40. Wire 36 is preferably niobium wire which has a thinner diameter and is more flexible than support wire 34. Gap 42 permits expansion of lead-in 30 during lamp operation without undue stress on welds 38 and 40. Also, welds 38 and 40 are somewhat insulated from extremely hot lead-in 30 because weld points 38 and 40 are at a distance from lead-in 30. A suitable getter, shown as getter 72 in the drawing, may be included for absorbing outer envelope contaminants, such as hydrogen, oxygen, etc.

Base 44 is mounted on neck 16 enclosing interior 46. The base region of lamp 10, as defined above, includes base 44 and interior 46. Support members 32 and 34 may be electrically bonded to ferrules 48 and 50, respectively, by brazing. The ferrules are formed from a material, e.g., a nickel iron alloy appropriate for sealing with the glass envelope, which may be embedded into glass neck 16 such that a hermetic seal may be obtained within outer envelope 12. In this embodiment of the invention, interior 56 is evacuated so that arc tube 22 does not lose heat via convection currents within outer envelope 12. This vacuum also insulates the base region of lamp 10 from convective heat flow from arc tube 22.

In order to provide electrical power to arc tube 22, wire 58 is electrically connected between prong 52 and ferrule 48, and wire 60 is electrically connected between prong 54 and ferrule 50. The ferrule connections may be made by welding or brazing, and the prong connections may be made mechanically or by soldering. Prongs 52 and 54 are electrically insulated from each other and from base 44. Prongs 52 and 54 protrude through base 44 and provide means for connecting lamp 10 with an external source of electrical power.

Lamp 10 includes starting aids as an integral part of the lamp. Ceramic NLDE 62 is mounted within interior 46 across prongs 52 and 54. Tungsten wire 64 is wound in a helix about arc tube 22 with one end welded to support 34. High intensity discharge lamps employing such starting aids are known in the art. For example, see U.S. Pat. No. 4,513,227, issued Apr. 23, 1985, to Labadini, and copending U.S. patent application with Ser. No. 694,563, filed Jan. 25, 1985, assigned to the assignee hereof.

NLDE 62 is a temperature-sensitive component. At high temperatures, the peak voltage of NLDE 62 is reduced. Although heating of NLDE 62 will not adversely affect start-up or operation of lamp 10, the hot-restrike capability of the lamp will be significantly deterred. In lamp 10, the base region is quite compact. Heating of the base region during lamp operation is due primarily to heat conducted from arc tube 22 through the electrical circuit which inherently provides good thermal conduction means.

Figure 2:
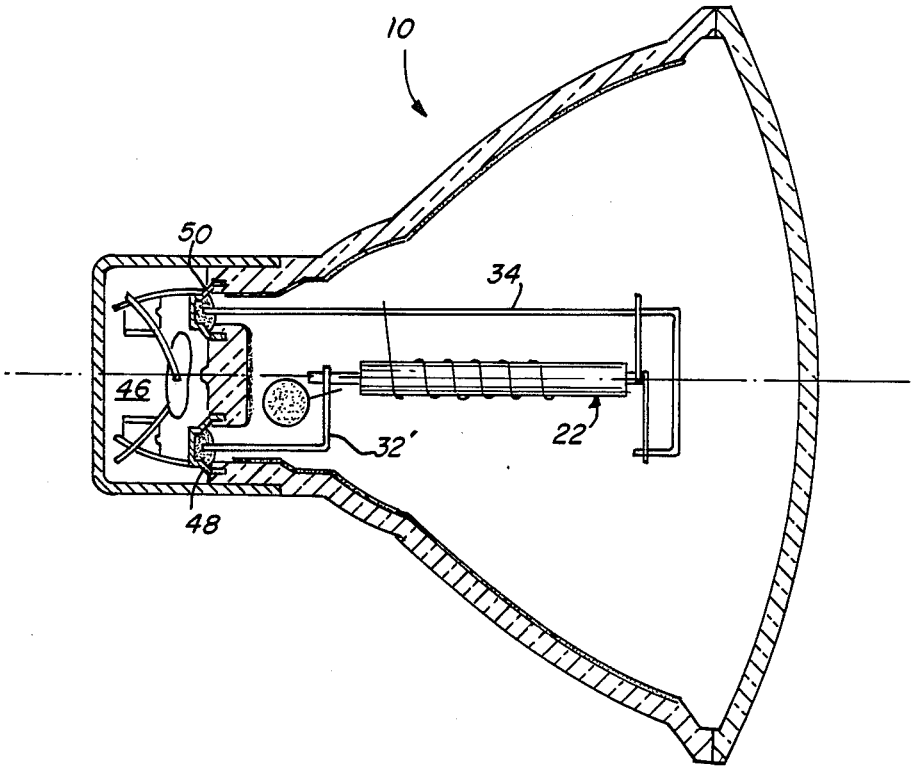
FIG. 2 PRIOR ART
FIG. 2 shows a typical construction of the prior art for the support members of a lamp similar to that of FIG. 1; the drawing is a cutaway view of internal lamp parts in elevation and the outer envelope in cross section.

FIG. 2 shows a typical prior art embodiment of the invention. Lamp 10 is identical to that of FIG. 1 except that support member 32′ of FIG. 2 is substantially shorter than support member 32 of FIG. 1. In the prior art lamp of FIG. 2, measurements surprisingly revealed an operating temperature difference of more than 40° C. between ferrules 48 and 50, with ferrule 48 being the hotter. These measurements were made within interior 46. The reason for the temperature difference is that member 32′ is considerably shorter than member 34 so that a greater amount of heat is conducted from arc tube 22 through member 32′ than is conducted through member 34. Accordingly, member 32′ was redesigned so that the amount of heat conducted through it during lamp operation will be approximately equal to that conducted through its counterpart, member 34. Returning to FIG. 1, support member 32 is adapted with loop 66 formed therein such that its effective thermal conductivity is approximately equal to that of support member 34 within the operating environment of lamp 10.

It does not necessarily follow that the lengths of support members 32 and 34 of FIG. 1 will be precisely equal. Each member will be heated to some extent by radiation from arc tube 22. The amount of radiant heat absorbed by each support member will depend largely on its shape and position with respect to the arc tube. There is no requirement that the cross-sectional areas of members 32 and 34 be equal, nor is there is a requirement that the two members be formed from identical materials. The critical aspect is that the thermal conductivity of both members to the base region be substantially equal in the operating environment of the lamp. In lamp 10 where members 32 and 34 are both formed from steel wire having the same diameter, the length of member 32 from ferrule 48 to the weld with lead-in 26 is approximately equal to the length of member 34 from ferrule 50 to weld point 38.

As has been suggested, reduction of heat transmission through member 32 may be accomplished by reducing the cross-sectional area of the member or by employing various geometrical shapes in various positions with respect to the arc tube. Since member 32 is a structural member in lamp 10, the cross-sectional diameter cannot be reduced significantly. In other embodiments of the invention, however, reducing the cross-sectional area of a support member may be an effective way to reduce the amount of heat conducted through the support member.

Figure 3:
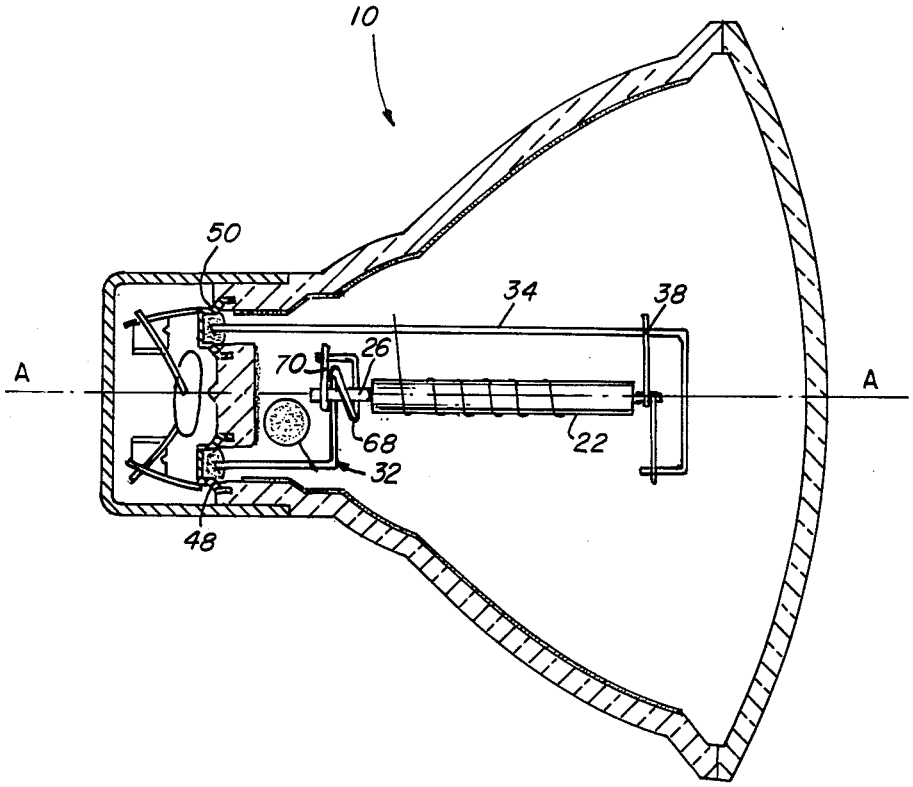
FIG. 3 shows an alternate embodiment of the invention; the drawing is a cutaway view of internal lamp parts in elevation and the outer envelope in cross section.

FIG. 3 shows lamp 10 with member 32 having a different shape than that of FIG. 1, namely with loop 68 encircling axis A—A and more particularly with loop 68 substantially encircing lead-in 26. The electrical connection between support 32 and lead-in 26 is made with niobium wire 70, e.g., by welding. In the embodiment of FIG. 3, the length of support wire 32 from ferrule 48 is approximately equal to the length of support wire 34 from ferrule 50 to weld point 38. Loop 68 of FIG. 3 has a slight advantage over loop 66 of FIG. 1 in that loop 68 will absorb less radiant heat from arc tube 22 because no part of loop 68 is in the path of direct arc tube radiation. Loop 66, on the other hand, is simpler and cheaper to construct and, as the performance data below will demonstrate, performs nearly as well as loop 68.

Figure 4:
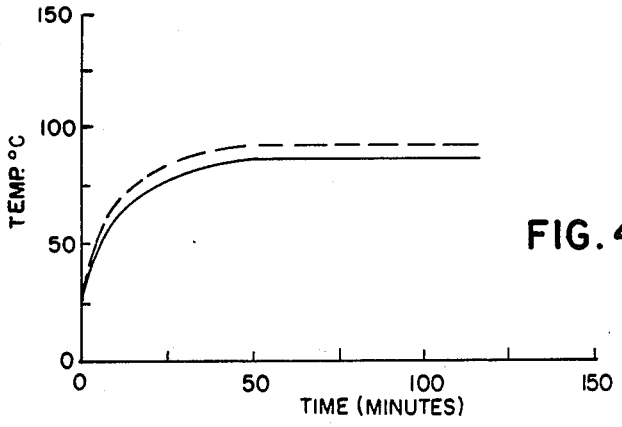
FIG. 4 shows plots of the temperature of both ferrules as a function of time from cold start-up in a laboratory example of a lamp of FIG. 1; the plot shown in a dashed line corresponds to the ferrule thermally coupled with the end of the arc tube mounted closer to the lamp base.
Figure 5:
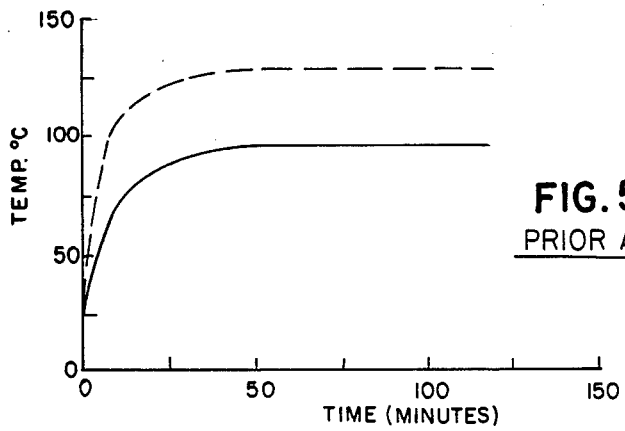
FIG. 5 PRIOR ART
FIG. 5 contains the same plots as shown in FIG. 4, except these plots pertain to a laboratory example of a typical lamp of the prior art as shown in FIG. 2.
Figure 6:
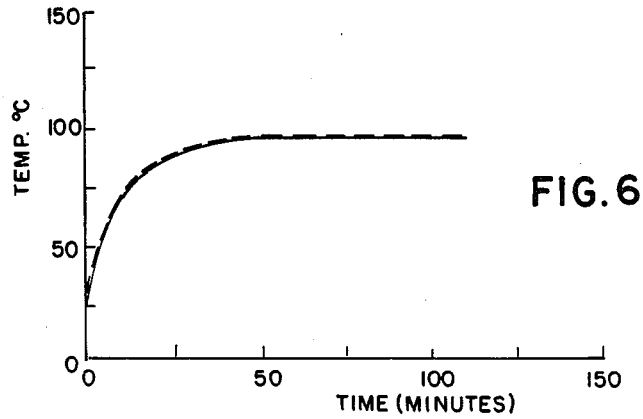
FIG. 6 contains the same plots as shown in FIG. 4, except these plots pertain to a laboratory example of a lamp as shown in FIG. 3.

FIGS. 4, 5, and 6 show graphs of performance data for the support members of laboratory examples of the lamps of FIGS. 1, 2, and 3, respectively. Each figure contains two plots. The first plot of each figure, shown in a dashed line, corresponds to the ferrule thermally coupled with the arc tube end closer to the base region of the lamp. The second plot of each figure, shown in a solid line, corresponds to the ferrule thermally coupled with the arc tube end farther from the base region. Each plot represents temperature in degrees Centigrade (on the vertical axis) as a function of time in minutes of lamp operation from cold start-up (on the horizontal axis).

In the three experimental lamps from which measurement for FIGS. 4, 5, and 6 were obtained, lamp orientation, placement of thermocouples, bonding agents, etc., were identical. Temperatures for each lamp ferrule were measured from within the base region. The base regions did not include any starting elements, such as NLDE 62 of FIG. 1, so as to avoid interference with the thermal measurement systems. The arc tube and support assemblies were installed in PAR-38 outer envelopes which included aluminized reflectors and clear lenses. The outer envelopes were hermetically sealed and exhausted. All units were constructed with medium side-prong bases. The lamps were run at 35 watts in air.

FIG. 5 shows a temperature disparity between the two ferrules of approximately forty degrees Centigrade in steady-state operation of a prior art lamp. This disparity leads to increased heating of the entire base region of the lamp including any starting element or elements within the base region. The fact that one ferrule is significantly hotter than the other will cause convection currents within the base region which will heat a starting element in the environment. The hotter ferrule also will transfer greater quantities of heat by conduction and radiation.

FIG. 4 shows a temperature disparity of approximately five degrees Centigrade between the two ferrules, and FIG. 6 shows essentially no temperature disparity. The data of FIG. 4 corresponds to the lamp shown in FIG. 1, while the data of FIG. 6 corresponds to the lamp shown in FIG. 3. As mentioned previously, the slight disparity in the lamp of FIG. 1 is believed to be due to the increased surface area of loop 66 exposed to direct arc tube radiation. The data of FIGS. 4 and 6 demonstrate the palpable advantage of employing a support member in accordance with the invention, especially where a temperature-sensitive component is employed within the base region of the lamp.

The data also shows that increasing the length of either support member will result in less heat being transferred to the base region through the support member, provided radiational effects are kept under control. Accordingly, the invention encompasses extending the lengths of both support members as well as equalizing the thermal conductivity of both members. For example, the support member thermally coupled with the arc tube end closer to the base region might contain two loops while the other member might contain a single loop. The member with two loops might employ a loop as shown in FIG. 1 in combination with a loop as shown in FIG. 3. Various combinations of sizes, positions, materials, and cross-sectional areas of support members, loops, or other configurations are possible such that the operating temperature of the base region will be minimized without adversely affecting the light-emitting characteristics or overall performance of the lamp. To the extent heat from the arc tube or light-source capsule can be conserved, the overall efficacy of the light source will be improved.

The scope of the invention extends to any lamp having a double-ended light-source capsule mounted axially within a single-ended outer envelope, including an A-line outer envelope. The fact that at present the best mode for carrying out the invention is embodied in a high-pressure sodium PAR lamp is not intended to limit the scope of invention nor is the fact that a temperature-sensitive component may be employed in the base region intended to be limiting.

While there have been shown and described what are at present considered to be preferred embodiments of the invention, it will be apparent to those skilled in the art that various changes and modifications can be made herein without departing from the scope of the invention as defined by the appended claims.

We claim:

1. A single-ended lamp comprising:

(a) an outer envelope having a longitudinal axis, a body, and a neck, at least a portion of said outer envelope being light-transmissive;

(b) a light-source capsule having a central axis and first and second opposed ends, said light-source capsule being mounted within said outer envelope such that said central axis is substantially coincident with said longitudinal axis and said first end is closer to said neck of said outer envelope than is said second end, each of said ends having a thermally conductive lead-in mounted therein, said light-source capsule being heat producing during operation of said lamp;

(c) first and second thermally conductive support members for supporting said light-source capsule, said first member being thermally coupled with the lead-in of said first end, said second member being thermally coupled with the lead-in of said second end;

(d) a base mounted on said neck, said base enclosing an interior, said interior being thermally coupled with said first and second support members;

(e) said first and second support members being separately adapted such that during operation of said lamp the amount of heat conducted to said interior through said first member is approximately equal to the amount of heat conducted to said interior through said second member; and (f) means for structurally and electrically completing said lamp.

2. A lamp as described in claim 1 wherein said first and second members are formed from first and second strips of metal wire, respectively.

3. A lamp as described in claim 2 wherein the length of said first strip of metal wire is approximately equal to the length of said second strip of metal wire.

4. A lamp as described in claim 3 wherein said first member includes at least one loop formed therein.

5. A lamp as described in claim 4 wherein said loop encircles said longitudinal axis.

6. A lamp as described in claim 5 wherein said loop substantially encircles said lead-in mounted in said first end of said light-source capsule.

7. A lamp as described in claim 2 wherein the cross-sectional diameter of said first strip of metal wire is less than the cross-sectional diameter of said second strip of metal wire.

8. A lamp as described in claim 1 wherein a temperature-sensitive component is contained within said interior of said base.

9. A lamp as described in claim 8 wherein said temperature-sensitive component is a non-linear dielectric element.

10. A lamp as described in claim 1 wherein said light-source capsule is a high-pressure sodium arc tube.

11. A lamp as described in claim 1 wherein said lamp includes a reflector having a focal center falling on said longitudinal axis.

12. A lamp as described in claim 11 wherein said lamp is a PAR-type lamp.

13. A lamp as described in claim 1 wherein said light-source capsule is a tungsten-halogen capsule.

14. A lamp as described in claim 8 wherein said light-source capsule is a tungsten-halogen capsule and said temperature-sensitive component is a diode.

15. A lamp as described in claim 4 wherein said second support member also contains at least one loop therein.

16. A lamp as described in claim 1 wherein said outer envelope is an A-line outer envelope.

* * * * *